United States Patent [19]

Titus et al.

[11] Patent Number: 4,766,598

[45] Date of Patent: Aug. 23, 1988

[54] ELECTRIC ARC FURNACE AND METHOD WITH COAXIAL CURRENT FLOW

[75] Inventors: Charles H. Titus, Newtown Square; J. Kenneth Wittle, Chester Springs, both of Pa.

[73] Assignee: Electric Power Research Institute, Inc., Palo Alto, Calif.

[21] Appl. No.: 2,563

[22] Filed: Jan. 12, 1987

[51] Int. Cl.[4] ..... H05B 7/20

[52] U.S. Cl. ..... 373/108; 373/72

[58] Field of Search ..... 373/72, 102, 103, 107, 373/108, 75, 73

[56] References Cited

U.S. PATENT DOCUMENTS 4,431,612 2/1984 Bell et al. .

4,618,963 10/1986 Rappinger et al. ..... 373/72

*Primary Examiner*—Roy N. Envall, Jr.

*Attorney, Agent, or Firm*—Flehr, Hohbach, Test, Albritton & Herbert

[57] ABSTRACT

Electric arc furnace and method suitable for use in the decomposition of hazardous materials such as polychlorobiphenyls (PCBs) and the like. The furnace has an electrically conductive hearth which is connected electrically to the bottom wall of the furnace shell. The arc producing potential is applied to the upper portions of a central electrode and the outer shell of the furnace, and the arc current flows in a coaxial manner in the central electrode and the side wall of the outer shell. The electrical connection between the hearth and the bottom wall of the outer shell is made by a plurality of electrode plates which extend upwardly from the bottom wall into the hearth. The electrode plates are arranged in a circular pattern of slightly greater diameter than the lower tip of the electrode, and the arc has a radial field component which causes it to rotate about the lower tip of the electrode. The potential is applied to the upper portion of the outer shell in a symmetrical manner to provide a substantially uniform distribution of current around the side wall.

11 Claims, 2 Drawing Sheets

ELECTRIC ARC FURNACE AND METHOD WITH COAXIAL CURRENT FLOW

This invention pertains generally to electric arc furnaces, and more particularly to an electric arc furnace and method which are suitable for use in the decomposition of hazardous materials such as polychlorobiphenyls (PCBs) and the like.

U.S. Pat. No. 4,431,612 discloses a direct current arc furnace for the destruction of PCBs and other hazardous materials, and U.S. Pat. No. 4,461,010 discloses a power supply for use in such a furnace.

In a DC arc furnace having an electrically conductive hearth on which the molten bath or solidified material to be heated rests and a single electrode for forming an arc with the molten bath or solidified material, it is important to provide a path of very low resistance between the power supply and the electrically conductive hearth. One of the problems in constructing such a furnace is how to effectively conduct the DC arc current from outside the furnace shell to the molten bath. Another problem is making good electrical contact with the electrically conductive hearth. It is also difficult to feed the DC current through the furnace shell without creating an opening through which the molten batch can leak. In addition, the furnace shell is typically fabricated of a magnetic material such as steel, and it is difficult to stabilize the arc and prevent it from being attracted to the steel shell.

It is in general an object of the invention to provide a new and improved arc furnace and method which overcome the foregoing and other disadvantages of DC arc furnaces heretofore provided.

Another object of the invention is to provide an arc furnace and method of the above character in which a path of low resistance is provided for the arc current between the power supply and the hearth on which the material to be heated rests.

Another object of the invention is to provide an arc furnace and method of the above character which can be implemented economically.

These and other objects are achieved in accordance with the invention by providing an arc furnace having an outer shell of electrically conductive material, an electrically conductive hearth connected electrically to the lower portion of the shell, and a cylindrical electrode positioned coaxially within the shell. The arc producing potential is applied to the upper portions of the electrode and the shell so that the arc current flows in a coaxial fashion in the electrode and in the side wall of the shell. The electrical connection between the hearth and the outer shell is made by a plurality of electrode plates which are mounted on the bottom wall of the shell and extend upwardly into the hearth. These plates are arranged in a circular pattern of somewhat greater diameter than the lower tip of the cylindrical electrode, and the arc has a radial component which causes it to rotate about the lower tip of the electrode. The potential is applied to the upper portion of the outer shell in a symmetrical manner to provide a substantially uniform distribution of current around the side wall.

Figure 1:
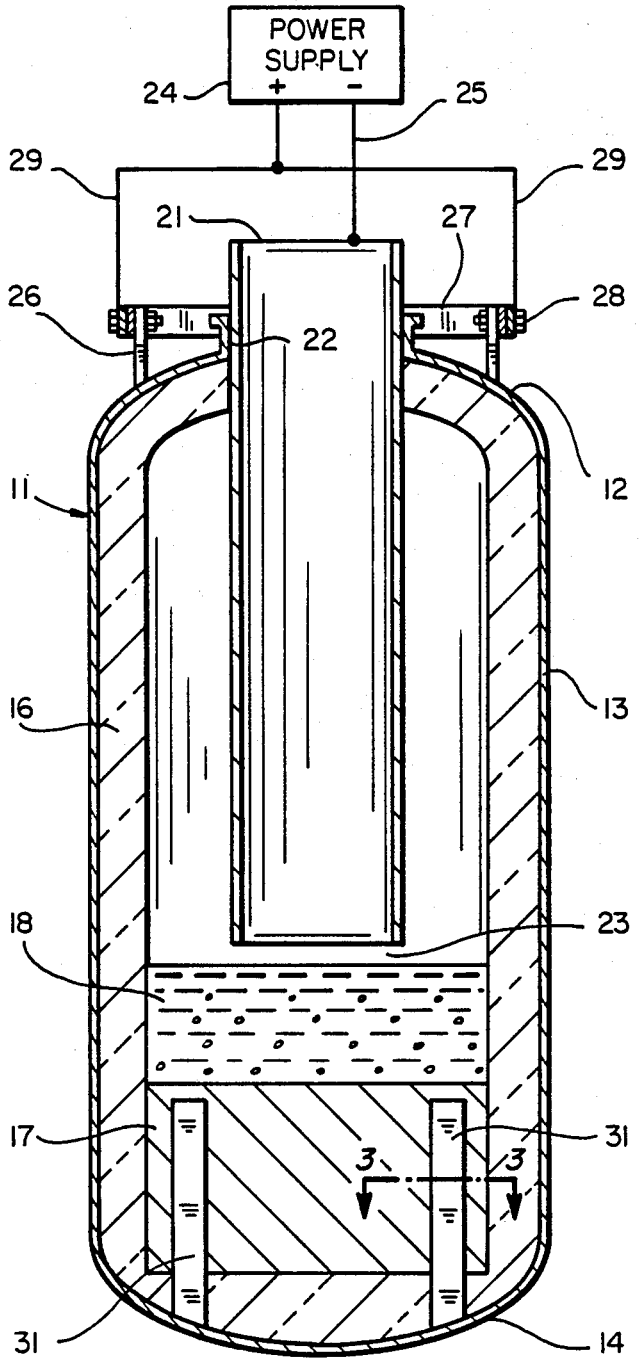
FIG. 1 is a centerline sectional view, somewhat schematic, of one embodiment of an arc furnace incorporating the invention.
Figure 2:
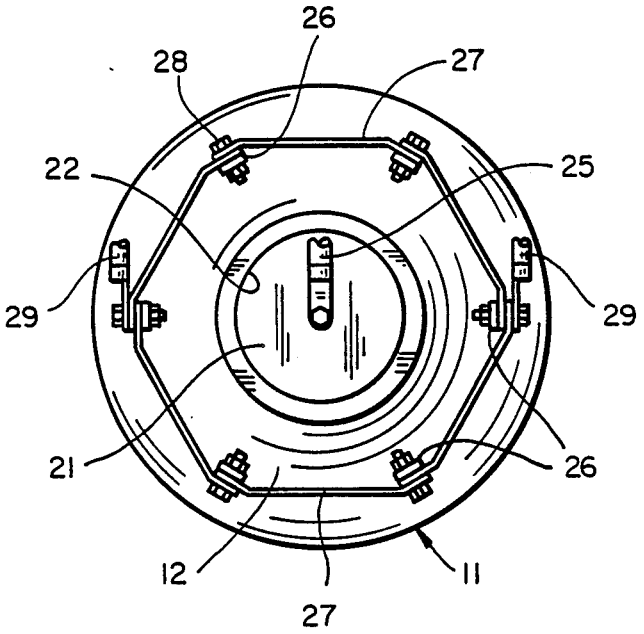
FIG. 2 is a top plan view of the embodiment of FIG. 1.
Figure 3:
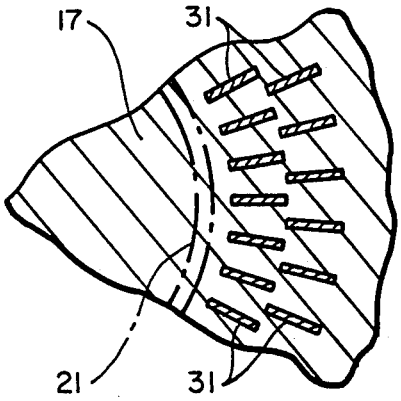
FIG. 3 is an enlarged fragmentary cross-sectional view taken along line 3–3 in FIG. 1.

As illustrated in the drawing, the arc furnace has an outer shell 11 fabricated of an electrically conductive material such as steel. The shell comprises a rounded top wall 12, a generally cylindrical side wall 13, and a rounded bottom wall 14 joined together as a unitary structure. The inner wall of the shell is lined with a thick layer 16 of insulative material such as tabular alumina or carbon wool.

A hearth 17 fabricated of an electrically conductive material such as graphite is positioned in the lower portion of the furnace above bottom wall 14. In one presently preferred embodiment, the hearth is fabricated of carbon or graphite blocks bonded together by an electrically conductive mastic to form a unitary structure. The material to be heated in the furnace is placed on the hearth and heated to form a melt 18.

A generally cylindrical electrode 21 fabricated of an electrically conductive material such as graphite is positioned coaxially within the side wall of outer shell 11. The electrode passes through an opening 22 in top wall 12 can be advanced and retracted in the axial direction by suitable means such as a rack and pinion drive mechanism (not shown). The lower tip of the electrode is spaced above the upper surface of melt 18 to form an arc gap 23. The upper portion of the electrode is connected to the negative terminal of a high current DC power supply 24 by a cable 25.

The positive terminal of the power supply is connected to the outer shell of the furnace near the top of side wall 13 so that the arc producing current flows down through the side wall to the bottom wall and from the bottom wall to hearth 17. By making the cylindrical electrode the negative electrode and the hearth and positive electrode, maximum energy is transferred to the melt and a minimum amount of graphite is eroded from the central electrode. To prevent any possible shock hazard to operating personnel, the outer shell is connected to an earth ground.

The power supply is connected to the upper portion of the outer shell in a symmetrical manner so that the current is distributed in a substantially even manner around side wall 13. The means for connecting the power supply to the outer shell comprises a plurality of upstanding posts 26 mounted on the top wall 12 in a generally circular pattern, with a bus bar 27 extending between the posts. In the embodiment illustrated, six posts are employed, and the bus bar extends between them in a hexagonal manner. The posts are fabricated of an electrically conductive material such as steel, and they are welded to the top wall of the furnace shell. The bus bar is fabricated of an electrically conductive material such as copper, and it is connected to the posts by bolts 28. The positive terminal of the power supply is connected to the bus bar by a plurality of water cooled cables 29 spaced symmetrically about the vertical axis of the furnace. In the embodiment illustrated, two cables are employed, and they are connected to the bus bar at diametrically opposed points.

Electrical conductivity between bottom wall and hearth 17 is provided by a plurality of generally rectangular electrode plates 31 which are mounted on the bottom wall and extend upwardly into the hearth. These plates are fabricated of an electrically conductive material such as steel, and they are joined to the bottom wall by suitable means such as welding. The plates are arranged in a generally circular pattern consisting of two concentric rings of plates, with the individual plates being oriented in a radial direction and the inner diameter of the inner ring being slightly greater than the diameter of electrode 21. This gives the arc a radial field component, which causes it to rotate around the lower tip of electrode 21. In one presently preferred embodiment, there are 70 equally spaced plates in each of the two rings.

The material to be heated is introduced into the furnace chamber through one or more charging chambers (not shown) to prevent direct communication between the furnace chamber and the surrounding atmosphere. Exhaust gases are removed from the furnace chamber through cylindrical electrode 21 and then processed by a gas scrubber (not shown).

A furnace constructed in accordance with the invention might, for example, have a chamber 7 feet in diameter and 12 feet high, with hearth 17 being about 5 feet thick and electrodes 21 being about 3½ feet long and 8 inches wide. Insulation 16 is about 30 inches thick. The melt typically has a dpeth on the order of 1–2 feet, and the furnace typically operates at a temperature on the order of 3,000° F., with an arc current on the order of 10,000 amperes.

Operation and use of the arc furnace, and therein the method of the invention, are as follows. The capacitors or other material to be melted are placed on hearth 17, and the furnace chamber is sealed. Electrode 21 is positioned a few inches above this material to form an arc gap, and the arc producing potential is applied to the electrode and to the outer shell of the furnace. The current flows in a coaxial manner in the electrode and in the side wall of the furnace shell, and the heat produced by the arc causes the material on the hearth to melt. As the melt progresses, the position of the electrode can be adjusted to maintain the proper arc gap with the molten bath. Additional capacitors can be added to the molten bath through the charging chambers while the furnace is operating, and the melt can be tapped off as desired without shutting down the furnace.

The invention has a number of important features and advantages. The arc producing current is applied to the electrically conductive hearth in a manner which does not require any penetration of the furnace shell. The voltage drop between the top and bottom of the furnace shell is very small, e.g. less than 1 volt, and the current flowing in the side wall stabilizes the arc by driving it away from the furnace shell. This minimizes erosion of the lining and avoids interference with the rotation of the arc at the tip of the electrode. By making the central electrode the negative electrode and the hearth the positive electrode, maximum energy is transferred to the melt, and a minimum of graphite is eroded from the electrode. The current flowing in the outer shell also creates a magnetic field in the furnace which is similar to that produced inside a coaxial cable. This helps to confine the highest plasma temperature to the vicinity of the lower tip of the hollow cylindrical electrode, thereby creating a very effective region for decomposing PCBs and other chemical molecules.

It is apparent from the foregoing that a new and improved arc furnace and method have been provided. While only certain presently preferred embodiments have been described in detail, as will be apparent to those familiar with the art, certain changes and modifications can be made without departing from the scope of the invention as defined by the following claims.

We claim:

1. In a electric arc furnace: an outer shell of electrically conductive material having a top wall, a generally cylindrical side wall and a bottom wall, an electrically conductive hearth positioned above the bottom wall and connected electrically to the lower portion of the outer shell for receiving a material to be heated, a vertically elongated electrically conductive electrode positioned coaxially within the outer shell and having a lower tip spaced above the hearth for forming a high current arc with the material to be heated means for connecting a first terminal of a high current power supply to the upper portion of the electrode, and means for connecting a second terminal of the power supply to the upper portion of the outer shell at a plurality of points spaced symmetrically about the side wall of the outer shell so that the current which forms the arc flows in and is distributed substantially uniformly around the side wall of the outer shell as it passes between the second terminal and the electrically conductive hearth.

2. The arc furnace of claim 1 wherein the second terminal of the power supply is connected to the top wall of the outer shell.

3. The arc furnace of claim 1 wherein the means for connecting the second terminal of the power supply to the upper portion of the outer shell includes a plurality of electrically conductive posts connected to the top wall and arranged in a generally circular pattern, and an electrically conductive bus extending between the posts.

4. The arc furnace of claim 1 including a plurality of electrode plates connected to the bottom wall and extending in an upward direction into the electrically conductive hearth.

5. The arc furnace of claim 4 wherein the electrode plates are arranged in a circular pattern of slightly larger diameter than the lower tip of the electrode.

6. The arc furnace of claim 1 wherein the positive terminal of the power supply is connected to the outer shell and the negative terminal of the power supply is connected to the electrode.

7. In an electric arc furnace: an outer shell of electrically conductive material having a top wall, a generally cylindrical side wall and a bottom wall, an electrically conductive hearth positioned above the bottom wall for receiving a material to be heated, a generally cylindrical electrode positioned coaxially within the outer shell and having a lower tip spaced above the hearth for forming a high current arc with the material to be heated, a plurality of electrode plates connected to the bottom wall of the shell and extending in an upward direction into the hearth, said electrode plates being arranged in a circular pattern or slightly greater diameter than the lower tip of the electrode so that the arc has a radial field component and rotates around the lower tip of the electrode, means for connecting the negative terminal of a high current power supply to the generally cylindrical electrode, a plurality of electrically conductive posts extending upwardly from the top wall of the outer shell in a generally circular pattern, an electrically conductive bus extending between the posts, and means for connecting the positive terminal bus on diametrically opposed sides of the top wall so that the current which produces the arc flows in and is distributed substantially uniformly around the side wall of the outer shell as it flows from the positive terminal to the electrically conductive hearth.

8. In a method of heating a material in an electric arc furnace having an outer shell of electrically conductive material with a top wall, a generally cylindrical side wall and a bottom wall, an electrically conductive hearth connected to the bottom wall for receiving the material to be heated, and an electrode positioned coaxially within the furnace and forming an arc gap with the material to be heated: applying an arc producing current to the electrode and to a plurality of points on the upper portion of the outer shell so that the current flows in coaxial fashion in the electrode and in the side wall and is distributed substantially uniformly around the side wall.

9. The method of claim 8 wherein the current is applied to the top wall of the outer shell.

10. The method of claim 8 wherein the arc producing current is conducted between the outer shell and the hearth by a plurality of electrode plates which extend from the outer shell into the hearth.

11. The method of claim 10 including the step of positioning the electrode plates in a circular array of slightly greater diameter than the electrode so that the arc has a radial component and rotates about the tip of the electrode.

* * * * *